United States Patent [19]

Barrett

[11] 4,264,887

[45] Apr. 28, 1981

[54] ELECTRO-LIFTING MAGNET

[75] Inventor: William T. Barrett, Waukesha, Wis.

[73] Assignee: Wehr Corporation, Milwaukee, Wis.

[21] Appl. No.: 963,420

[22] Filed: Nov. 24, 1978

[51] Int. Cl.[3] ..... H01F 7/20

[52] U.S. Cl. ..... 335/291; 335/289

[58] Field of Search ..... 335/291, 292, 299, 289, 335/290

[56] References Cited

U.S. PATENT DOCUMENTS

| | | | |
|---|---|---|---|
| 2,761,094 | 8/1956 | Frampton | 335/291 |
| 3,521,209 | 7/1970 | Fritz | 335/299 |
| 3,984,796 | 10/1976 | Frampton | 335/291 |

*Primary Examiner*—Harold Broome

[57] ABSTRACT

A coil for an electromagnet is made up of a spiral wound, anodized aluminum strip, and a strip of magnetic material wound in interleaved fashion with the central portion of the aluminum strip. The magnetic material strip is electrically insulated from the aluminum strip and the aluminum strip is electrically energized to excite the magnet. The magnetic material strip is wider than the aluminum strip and extends beyond both opposite edges of the aluminum strip to make direct contact with the coil housing and a pole shoe. Electrical insulating material fills the cavity defined by the magnetic strip projecting beyond the edges of the aluminum strip.

32 Claims, 6 Drawing Figures

ELECTRO-LIFTING MAGNET

BACKGROUND OF THE INVENTION

This invention relates to lifting magnets and, more particularly to increasing the lifting force and overall performance of the lifting magnet.

Conventional electro-lifting magnets generally have a circular, E shaped in cross section body of ferromagnetic material. The body defines a central core surrounded by outer legs which are spaced from the central core, the core and legs being connected by a yoke. An electrical coil fills the area between the core and legs so that, when the coil is energized electrically, a flux field is generated by magnetic flux flowing between a central pole (the core) and an outer pole (the outer legs) and through the yoke. When the magnet is excited in that manner, it can be used to pick up, and transfer, a load positioned within the flux field. Generally pole shoes are associated with the free ends of the poles to assist in flux distribution in the flux field.

The lifting force of the magnet is dependent upon the amount of flux generated when the magnet is excited which in turn is directly dependent upon, among other things, the ampere-turns of the electrical coil.

Another factor to be considered in evaluating the overall efficiency or performance of the magnet is the ability of the coil to dissipate self generated heat occuring when the magnet is excited. If the coil is able to dissipate this heat, it can operate at a lower temperature and more efficiently or it can operate at higher current level thus increasing the available ampere-turns.

U.S. Pat. No. 3,521,209 is concerned with the general problem of improving the operation of an electro-lifting magnet. That patent suggests replacing a portion of a conventional electric coil, normally made of non-ferromagnetic material, with a ferromagnetic material. Both non-ferromagnetic and ferromagnetic coil portions were energized electrically to excite the magnet.

Among the general objects of this invention is to increase the lifting force of an electro-lifting magnet and/or to increase the overall performance or operating efficiency of the magnet.

SUMMARY OF THE INVENTION

For the achievement of these and other objects, this invention proposes an arrangement wherein the electromagnet has an electrically conductive coil portion connected to an electrical source for exciting the magnet. A second coil portion of magnetic material is wound with at least a portion of the conductive coil but is electrically insulated from the conductive coil so that only the conductive coil portion is energized electrically when the magnet is excited. This results in a coil at least a portion of which is a combination of conductive, nonmagnetic material and magnetic material. In addition, the conventional core is eliminated leaving an open area between the outer poles, in a circular magnet. The open area is defined by the outer annular leg. The open area is filled by just described coil. It is preferred that the coil be arranged such that the combination coil portion is located centrally of the otherwise open area. This places the combination coil generally in the area where the conventional core would have been and it is surrounded by the remainder of the electrically conductive, nonmagnetic coil portion to fill the area defined by the outer poles.

This arrangement achieves an increase in the ampere-turns of coil and will generate more flux, and consequently a greater lifting force, than a conventional magnet of the same general overall size.

Structurally, it is desirable that the coil be formed from strips having length, width and thickness dimensions. The strips are spiral wound on their thickness dimension and the magnetic material strip is wound with the conductive non-magnetic strip so that they are interleaved in a layered arrangement. The strips are mutually exposed to each other across their width surfaces, an advantageous feature which will be discussed hereinafter.

In the preferred construction, the electrically conductive strip is made of anodized aluminum and is wound in direct contact with the magnetic strip, the later being made of steel or other ferromagnetic material. With that arrangement, maximum surface exposure is achieved between the ferromagnetic strip and the anodized aluminum strip to achieve better heat transfer therebetween. This coil construction has a greater ability to dissipate self-generated heat which occurs in the anodized aluminum strip upon excitation of the magnet.

It is also desirable to provide the anodized aluminum coil with a width dimension which is less than that of the steel coil. The aluminum coil is then arranged such that the steel coil extends beyond the opposite edges of the aluminum coil and the cavity formed at each end is filled with a bonding material which also has electrical insulating properties to hold the necessary spacing, for example a suitable epoxy. With that arrangement, one set of the protruding edges of the steel strip are arranged in direct contact with the body of the magnet so that heat transferred to the steel strip is transferred in turn to the magnet body which increases the area available for dissipation of self-generated heat to the ambient. This is possible because the steel strips are electrically isolated from the electrical energizing current and thus there is no danger of shorting the electrical coil.

It is also conventional in magnets of this type to provide pole shoes to enhance distribution of the flux which is generated by the magnet. Where pole shoes, or the like, are used, a shoe can be placed in direct contact with the other set of protruding edges of the steel strip for better heat transfer to the pole shoe and consequential dissipation of that heat to the ambient.

With this enhanced heat dissipation capability, the electrical coil is capable of dissipating a greater amount of watts so that it can run more efficiently at a lower temperature for a given amperage level or, alternatively, the amperage can be increased to thereby achieve a further increase in ampere-turns.

Other objects and advantages will be pointed out in, or be apparent from, the specification and claims, as will obvious modifications of the embodiments shown in the drawings, in which:

DESCRIPTION OF THE PREFERRED EMBODIMENT

An electro-lifting magnet 1 is illustrated as including a body 2 made of suitable ferromagnetic material, such as steel. The body is defined by a generally circular yoke 3 and an annular member 4 which is integral with and projects laterally from the yoke around its circumference.

Figure 1:
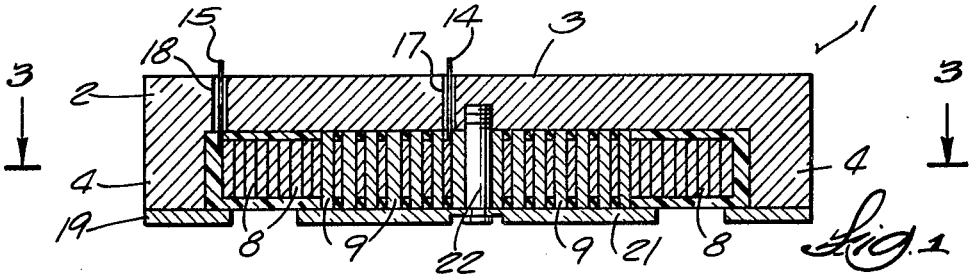
FIG. 1 is a cross section of an electro-lifting magnet embodying this invention.
Figure 3:
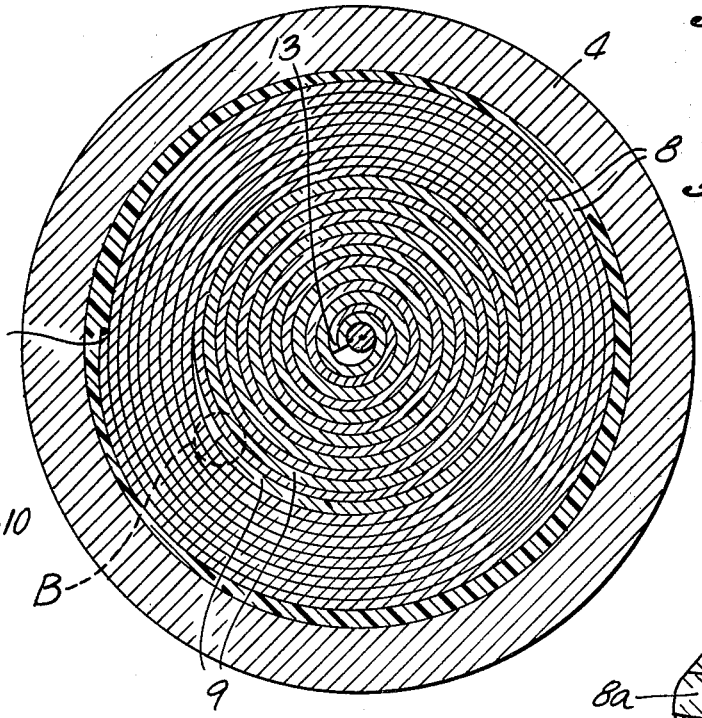
FIG. 3 is a section view taken generally along 3—3 of FIG. 1.

This general configuration of the magnet is perhaps best illustrated in FIG. 3. In cross section as illustrated in FIG. 1, the magnet body is generally U-shaped with the yoke 3 defining the bight of the U and the annular member 4 defining opposed leg portions.

Figure 2:
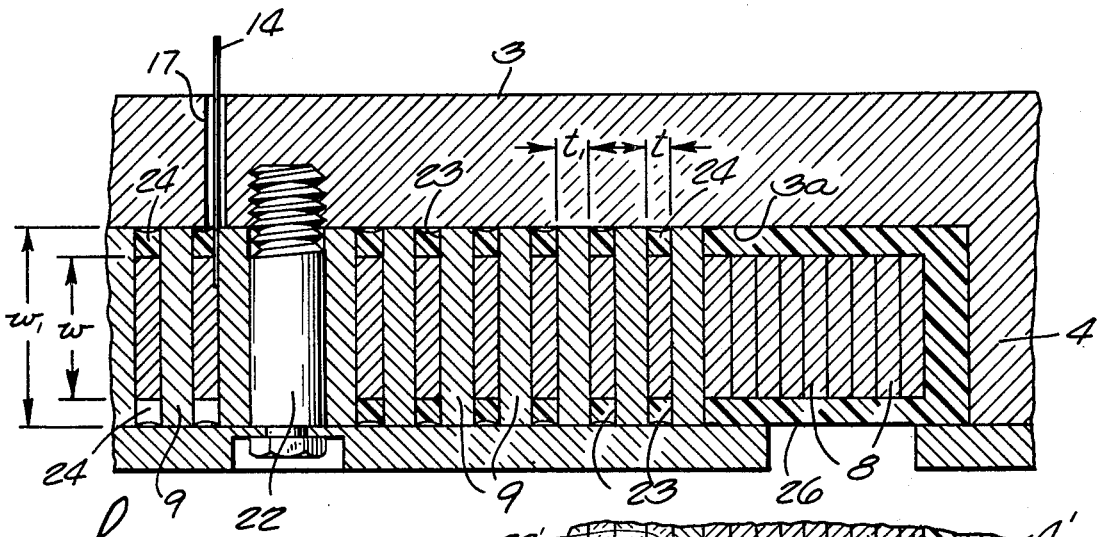
FIG. 2 is an enlarged view of area A in FIG. 1.

In contrast to the conventional prior art type electro-lift magnets which are generally E-shaped in cross section, the electromagnet of this invention eliminates the central core. With the core eliminated, the area 6 defined by the yoke 3 and annular member 4 is generally open, i.e., open between the opposed legs 4 in FIG. 1. The open area so defined is filled by a coil 7, the structure of which is best illustrated in FIGS. 2 and 3.

Figure 4:
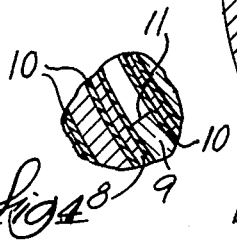
FIG. 4 is an enlarged view of part of area B from FIG. 3.

More particularly, a continuous strip 8 is wound on itself from the center of area 6 outwardly to the annular member 4. Strip 8 is made of an electrically conductive, nonmagnetic material. Preferably that material is anodized aluminum so that an electrical insulating coating 10 is provided over all of the exposed surfaces of strip 8; the coating is shown enlarged in FIG. 4 for illustrative purposes.

A second strip 9 is also wound on itself from the center of area 6 and outwardly toward annular member 4 but terminates at an end 11 which is intermediate the center of area 6 and the annular member 4. Strip 9 is preferably made of a magnetic material such as steel. In the preferred embodiment, strips 8 and 9 are wound together in interleaved fashion until strip 9 terminates at end 11. From end 11 strip 8 continues to be wound alone to its end 12. In cross section the coil is made up of strips 8 and 9 in alternating, layered arrangement and only layered strip 8 in the radially outer area.

Terminals 14 and 15 are connected to ends 13 and 12, respectively, of strip 8. Terminals 14 and 15 extend through openings 17 and 18 respectively in yoke 3. These electrical terminals are connected to a suitable source of electrical energy (not shown) so that coil 8 can be electrically energized to excite the magnet 1.

With this construction, the coil 7 includes a portion having interwound, specifically interleaved, strips 8 and 9. In the preferred embodiment, this portion of the coil is located centrally in area 6 where the conventional core of conventional electromagnets would otherwise be located. The remainder of the coil consists only of strip 8 which surrounds the central portion and completes the filling of area 6.

In the preferred embodiment, the strips 8 and 9 each have a length dimension l, width dimension w and thickness dimensions t. The strips are wound on their thickness dimension so that the width surfaces of strips 8 and 9 abut. The coating of the annodized aluminum strip maintains electrical insulation between the steel and aluminum strips. Accordingly, when coil 8 is electrically energized, current is in that coil but not in coil 9 and strip 8 electrically excites (induces magnetization in) both the body 2, i.e. yoke 3 and annular member 4, and strip 9 to generate magnetic flux useful in lifting a load with the electromagnet. The flux is generated below the magnet between strip 9 and the annular member 4.

The structure just described provides an increased effective amount of ampere-turns as compared with conventional electromagnets and as a result, a greater amount of flux is generated and the magnet exhibits a greater lifting force. This is believed to be a result of the energizing coil 8 having a portion which is dispersed through an area of the magnet which in conventional magnets would be occupied solely by core. In addition, it is believed that strip 9 functions in the nature of core but more effectively because it is interleaved with the energizing coil 8. Furthermore, ampere-turns can be increased because strip 8 is capable of operating at a lower temperature due to the increased heat transfer which results from the greater surface contact between it and a heat dissipating body strip 9, i.e. greater as compared to prior art coil and core arrangements, and this can be operated at higher amperage if desired.

It is generally common practice in a lifting magnet to provide some type of a pole shoe which cooperates with the flux generating members to achieve a more uniform distribution of flux through the magnetic field working area, i.e., the area opposite to yoke 3. Such pole shoes are also included in the preferred embodiment of this invention. An annular pole shoe 19 is connected to annular member 4 and is in flux transfer relation therewith. A circular pole shoe 21 is also included and this pole shoe is disposed in the area of the combination coil made up of strips 8 and 9.

Structurally, it will also be noted that a bolt or pin 22 is included in the magnet. This bolt 22 is used in the nature of a winding mandrel on which the coil 7 can be wound and also, as illustrated, to hold the pole shoe 21 in position.

So long as the strip 8 is electrically insulated from the body 2 of the magnet and the strip 9 various structural relationships can be utilized. Preferably, because of the electrically neutral condition of strip 9 it need not be electrically insulated from the electromagnet body and can in fact directly engage that body to simplify the construction.

Moreover, the fact that the strip 9 can directly engage the body of the electromagnet is utilized to advantage in further enhancing the overall operation of the magnet. This will now be described in more detail. With specific reference to FIG. 2, it will be noted that the width of strip 8 is less than the width of strip 9. The strip 8 and 9 are so arranged that the ends of the strip 9 extend beyond the edges of strip 8. The cavity 23 defined by this relationship between the strips is filled with a suitable electrical insulating and structurally bonding material 24, this material can be a suitable epoxy. The epoxy 24 maintains the relative spacing between strips 8 and 9. A similar epoxy material 26 is provided around the portion of coil 8 which is disposed between the combination coil and the yoke 3 and annular member 4. This is illustrated in FIGS. 1 and 2.

As viewed in the drawings, the upper edges of strip 9 are in direct contact with the inside planar surface **3*a* of yoke 3. This places the strip 9 in direct heat transfer, as well as flux transfer, relationship with the yoke. From a heat transfer standpoint, the self-generated heat created when coil 8 is electrically energized is transferred to strip 9 and through it to body 3** for more effective dissipation, to the ambient.

It is also desirable where a pole shoe 21 is used, to place the lower edges of strip 9 in direct contact with that pole shoe. Again, this places the strip 9 indirect heat transfer as well as flux transfer relationship with the pole shoe 21. Thus the pole shoe 21 also acts as an additional surface for dissipating self-generating heat to the ambient.

With this overall construction, the energizing coil 8 can operate at a far lower, and more efficient temperature than in conventional magnets because it is better able to dissipate its self-generated heat. Alternatively, the coil could be operated at a higher ampere level to thereby produce a still further increase in available ampere-turns, flux and lifting force.

Figure 5:
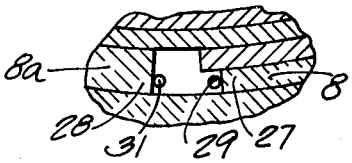
FIG. 5 is an enlarged view of a similar area B of the lifting magnet but showing an alternative electrical connection.

In a typical embodiment, the coil 9 is made from cold rolled steel and is approximately 0.018 inches thick. The anodized aluminum strip 9 is approximately 0.012 inches thick to maintain a balance of approximately 40% electrically conductive coil to 60% steel coil in the combination coil area. This is a good operating balance of conductive and nonconductive material in that area. The strip 8 can have a uniform thickness out to its end 12 or, as an alternative, the coil when it is no longer interleaved with the strip 9 can have an increased thickness, i.e., 0.024 inches as opposed to 0.012. This alternative is illustrated in FIG. 5 where coil 8 is seen as terminating at an end 27 and resuming as a coil 8*a* from end 28. The thicker strip in the radially outer portion of coil 7 is desirable as it provides a better current carrying capacity in that area, the thinner coil can be used in the radially inner portion because of the better heat dissipation which is achieved with the heat transfer relation described above.

FIG. 5 illustrates yet an additional alternative embodiment of this invention. Whereas, in the embodiment of FIGS. 1, 2 and 3, the entire length of the aluminum strip 8 is electrically energized from a single electrical source, the coil can be separated so that the portion which interleaved with strip 9 is energized from one electrical source and the radially outer, aluminum coil only portion is electrically energized from a separate source. In that respect, the end 27 of coil 8 is connected to a terminal 29 so that terminals 14 and 29 energize the inner portion of the coil. Terminal 21 is connected to end 28 of coil 8*a* so that the outer portion of the coil is energized by terminals 31 and 16. Thus, the two portions of the electrical energizing coil can be energized at different current levels depending upon the desired performance.

Figure 6:
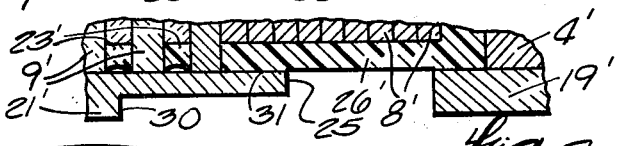
FIG. 6 is a partial view showing an alternative embodiment of the invention.

FIG. 6 illustrates a modification of the central pole shoe which provides for control over the intensity of the magnetic field generated and/or the distribution of flux in the field.

One of the criteria for the central pole shoe is that it cover the area in which ferromagnetic strip 9 is located so that a path is provided for ready emanation of flux. In FIG. 6, the central pole shoe 21' extends over the area including the ferromagnetic strips 9' and has an outer circumferential edge 25 which is spaced from the outer pole shoe 19'. A shoulder 30 is provided around the circumference of the pole shoe. The shoulder provides an annular portion 31 of reduced cross section (reduced as compared to the cross section of the central area of the pole shoe 21') around the circumference of the pole shoe. The shoulder faces outwardly of the magnet assembly so that the pole shoe may still engage all of the ferromagnetic strips 9'.

With this configuration, the flux emanating from the ferromagnetic strips will tend to exit the pole shoe through the radially inward area of increased cross section, i.e., the central area of the pole shoe. This concentrates the flux in the central area and makes for a more intense field. By varying the radial length of the shoulder, the configuration of the flux field can be varied as desired. In a typical embodiment, the pole shoe had a 28 inch outside diameter, i.e. out to edge 25. The shoulder 30 was cut back 4 inches from wedge 25 leaving the central, increased thickness portion with a 20 inch outside diameter. That relationship provided satisfactory results for the just described purpose.

Although this invention has been illustrated and described in connection with particular embodiments thereof, it will be apparent to those skilled in the art that various changes and modifications may be made therein without departing from the spirit of the invention or from the scope of the appended claims.

I claim:

1. An electromagnet comprising, in combination, a generally U-shaped in cross section member having ferromagnetic properties and being formed by a bight portion and oppositely spaced leg portions on and extending laterally from said bight portion, means defining a plurality of electrically conductive strips in layered arrangement in the area defined by said oppositely spaced leg portions and said bight portion, means for electrically connecting said electrically conductive strips to a source of electrical power to electrically energize said strips, means defining a plurality of ferromagnetic strips interleaved with a portion only of said electrically conductive strips so that said electrically conductive strips and said ferromagnetic strips substantially fill said area with a first layered portion comprising only said electrically conductive strips and a second layered portion comprising alternating strips of said electrically conductive and ferromagnetic strips, and means electrically insulating said ferromagnetic strips from said electrically conductive strips.

2. The electromagnet of claim 1 wherein said strips have length, width and thickness dimensions and are layered along their thickness dimension.

3. The electromagnet of claim 1 wherein said electrically conductive strips comprise anodized aluminum and are thereby electrically insulated from said ferromagnetic strips.

4. The electromagnet of claim 1 wherein said bight portion is generally circular, and said leg portions are a part of and are formed by a generally cylindrical member, said cylindrical member surrounding and extending laterally from said bight portion.

5. The electro-magnet of claim 1 wherein said interleaved ferromagnetic strips and electrically conductive strips are located generally centrally in said area, including a pole shoe of ferromagnetic material extending over said interleaved ferromagnetic and electrically conductive strips, and including means defining a shoulder around the periphery of said pole shoe so that said pole shoe includes a first, central portion of one thickness and a second, outer portion of a thickness less than that of said central portion.

6. An electromagnet comprising, in combination, a generally U-shaped in cross section member having ferromagnetic properties and being formed by a bight portion and oppositely spaced leg portions on and extending laterally from said bight portion, means defining first and second coil means portions disposed between and substantially filling the area betweeen said oppositely spaced leg portions, said first coil means portion comprising a plurality of layers of electrically conductive strips arranged with a surface of one strip confronting a surface of an adjacent strip, said second coil means portion comprising a plurality of layers of electrically conductive strips interleaved with a plurality of ferromagnetic strips and arranged with a surface of one strip confronting a surface of an adjacent strip, means electrically insulating said ferromagnetic strips from said electrically conductive strips, and means for electrically connecting the electrically conductive strips of said first and second coil means portions to a source of electrical power for electrically energizing the conductive strips in each said portions.

7. The electromagnet of claim 6 wherein said strips have length, width and thickness dimension and are layered along their thickness dimension.

8. The electromagnet of claim 6 wherein said electrically conductive strips comprise anodized aluminum and are thereby electrically insulated from said ferromagnetic strips.

9. The electromagnet of claim 6 wherein said bight portion is generally circular, and said leg portions are a part of and are formed by a generally cylindrical member, said cylindrical member surrounding and extending laterally from said bight portion.

10. The electromagnet of claim 6 wherein said electrically conductive strips of said first and second coil means portions are separately electrically energized one from the other.

11. The electro-magnet of claim 6 wherein said interleaved ferromagnetic strips and electrically conductive strips are located generally centrally in said area, including a pole shoe of ferromagnetic material extending over said interleaved ferromagnetic and electrically conductive strips, and including means defining a shoulder around the periphery of said pole shoe so that said pole shoe includes a first, central portion of one thickness and a second, outer portion of a thickness less than that of said central portion.

12. An electromagnet comprising, in combination, a housing having ferromagnetic properties, said housing having a generally circular yoke portion and a generally cylindrical portion surrounding and projecting from said yoke portion around the circumference thereof, a spiral wound, electrically conductive strip within the area defined by said yoke and cylindrical portions, a spiral wound, ferromagnetic strip interleaved with a portion only of said conductive strip and electrically insulated therefrom, said electrically conductive and ferromagnetic strips substantially filling said area so that said area is filled by a first portion comprising only said electrically conductive strip and a second portion comprising said electrically conductive strip alternately layered with said ferromagnetic strip, and circuit means for electrically connecting said conductive strip to an electrical source for electrically energizing said conductive strip.

13. The electromagnet of claim 12 wherein said strips have length, width and thickness dimensions and are wound on their thickness dimension.

14. The electromagnet of claim 12 wherein the portion of said electrically conductive strip interleaved with said ferromagnetic strip is electrically separate from the remaining portion thereof, and said circuit means is operative to connect said separate conductive strip portions to said electrical source for separate electrical energization of said electrically conductive strip portions.

15. The electromagnet of claim 12 wherein said ferromagnetic strip is in magnetic inductive relation with said housing so that said ferromagnetic strip and housing are magnetized upon electrical excitation of said conductive strip, and wherein said portion of said conductive strip interleaved with said ferromagnetic strip is arranged generally centrally of said area with said remaining portion thereof surrounding said interleaved portion and disposed between said interleaved portion and said cylindrical portion.

16. In an electromagnet having a housing member of magnetic material and an electrical coil in magnetic inductive relationship with said housing member, the improvement comprising a plurality of electrically conductive strip means in layered arrangement defining said coil, a plurality of strip means of magnetic material in interleaved layered arrangement with at least a portion of said electrically conductive strip means, means electrically insulating said magnetic material strip means from said electrically conductive strip means, and means for connecting said electrically conductive strips to a source of electrical power to electrically energize said strips and induce magnetization in said housing member, said strip means having length, width and thickness dimensions and being layered along their thickness dimension, the width of said electrically conductive strip means being less than that of said magnetic material strip means and said strip means relatively arranged so that the edges of said electrically conductive strip means are spaced inwardly of the corresponding edges of said magnetic material strip means.

17. The combination of claim 16 including means defining a surface on said housing member which faces toward said coil and is in contact with the edges of said magnetic material strip means.

18. The combination of claim 16 including means of electrical insulating material disposed in and confined within each area defined by an edge of said electrically conductive strip means and the portions of the strip means of magnetic material extending beyond said edge of said electrically conductive strip means.

19. The combination of claim 16 wherein said electrically conductive strip means is made of anodized aluminum.

20. The combination of claim 16 wherein said magnetic material strip means has a first set of edges facing toward and in contact with said housing member and a second set of edges facing away from said housing member, including a pole shoe of magnetic material, and wherein said pole shoe extends over and is in contact with said second set of edges.

21. The combination of claim 16 including means in said pole shoe defining a shoulder around the periphery thereof so that said pole shoe has a central area of one thickness and an outer area of thickness less than said central area and extending around said central area.

22. The combination of claim 17 wherein said housing is generally U-shaped in cross section being formed by a yoke portion and leg portions, said leg portions oppositely spaced on and extending laterally from said yoke portion, and wherein said electrically conductive strip means and said magnetic material strip means substantially fill the area defined by said oppositely spaced leg portions and said yoke portion.

23. In an electromagnet having a coil housing member of magnetic material and an electrical energizing coil in magnetic inductive relationship with said housing member, the improvement comprising means defining a generally planar surface on said housing member facing toward said coil, a plurality of electrically conductive strip means in layered arrangement defining said coil, a plurality of strip means of magnetic material in interleaved layered arrangement with at least a portion of said electrically conductive strips and having a first set of edges facing toward and in contact with said planar surface and a second set of edges facing away from said planar surface, means electrically insulating said magnetic material strip means from said electrically conductive strip means, means for connecting said electrically conductive strips to a source of electrical power to electrically energize said strips and induce magnetization in said housing member, said strip means having length, width and thickness dimensions and being layered along their thickness dimension, the width of said electrically conductive strip means being less than that of said magnetic material strip means and said strip means relatively arranged so that the edges of said electrically conductive strip means are spaced inwardly of the corresponding edges of said magnetic material strip means, and a generally planar pole shoe of magnetic material spaced from and extending generally parallel to said planar surface, said pole shoe in contact with second set of edges.

24. The combination of claim 23 including means of electrical insulating material disposed in and confined within each area defined by an edge of said electrically conductive strip means and the portions of the strip means of magnetic material extending beyond said edge of said electrically conductive strip means.

25. The combination of claim 23 wherein said electrically conductive strip means is made of annodized aluminum.

26. The combination of claim 23 wherein said housing is generally U-shaped in cross section being formed by a yoke portion and leg portions, said leg portions oppositely spaced on and extending laterally from said yoke portion, and wherein said electrically conductive strip means and said magnetic material strip means substantially fill the area defined by said oppositely spaced leg portions and said yoke portion.

27. The combination of claim 26 wherein said yoke portion is generally circular and said leg portions are a part of and formed by a generally cylindrical member connected to and extending laterally from said yoke portion.

28. The combination of claim 27 wherein said strip means are spiral around.

29. The combination of claim 28 wherein the thickness of said conductive strip means interleaved with said magnetic material strip means is less than the thickness of said magnetic material strip means.

30. The combination of claim 29 wherein the thickness of said conductive strip means is approximately two thirds of the thickness of said magnetic material strip means.

31. The combination of claim 30 wherein said strip means are interleaved through only a portion of said coil and said thickness relationship occurs in said portion, said conductive strip means alone makes up the remainder of said coil and the thickness of said conductive strip means in said remainder of said coil has a thickness approximately twice that of the conductive strip means in said interleaved portion.

32. The combination of claim 16 wherein said magnetic material strip has the edges thereof in contact with said housing member.

* * * * *